United States Patent [19]

Park

[11] Patent Number: 4,563,777

[45] Date of Patent: Jan. 14, 1986

[54] COMBINATION CARGO PACK

[76] Inventor: Taekyu Park, c/o York East Merchandise, Inc., 350 Fifth Ave., New York, N.Y. 10118

[21] Appl. No.: 627,656

[22] Filed: Jul. 3, 1984

[51] Int. Cl.[4] ..... A41D 1/02; A41D 1/00; A41D 3/02

[52] U.S. Cl. ..... 2/108; 2/85; 2/94

[58] Field of Search ..... 2/94, 108, 85, 86

[56] References Cited

U.S. PATENT DOCUMENTS

| | | | |
|---|---|---|---|
| 2,165,384 | 7/1939 | Diaber | 2/94 |
| 4,347,629 | 9/1982 | Itoi | 2/108 |
| 4,404,687 | 9/1983 | Hager | 2/94 |
| 4,502,154 | 3/1985 | Itoi | 2/108 |

*Primary Examiner*—Doris L. Troutman

[57] ABSTRACT

A combination cargo pack in the form of a soft side carry pack has straps for independent shoulder supported usage and incorporates an article of wearing apparel adapted for storage within the pack. The cargo pack is provided with a plurality of load carrying compartments including a garment pouch defined between an interior partition within the pack and a releasably securable front panel of the pack. The front panel provides a flap closure for removably storing the garment, which also cushions the load. The back of the garment is attached in registered relationship with the interior partition such that, when the garment is worn, the cargo pack and shoulder straps will be functionally operative for supporting the load. The flap closure is further designed for retention, when the garment is worn, in a rolled position by a tie-down strap and cooperating buckle arrangement.

10 Claims, 5 Drawing Figures

COMBINATION CARGO PACK

TECHNICAL FIELD

This invention relates generally to baggage and especially to knapsacks and other body carried travel bags.

In particular, the invention of this device concerns a combination cargo pack having a plurality of storage compartments including an integrally stowed garment.

BACKGROUND ART

The use of backpacks and other shoulder supported personal travel bags have been widely accepted by youthful travelers, campers, hikers, bikers, hunters and by other persons engaged in similar outdoor activities. Frequently, the traveler encounters changes in weather conditions which may require a protective body covering. The availability of such clothing without time consuming unpacking of the baggage would be advantageous, particularly in the event of a rain storm. Furthermore, the traveler may inadvertently fail to include such a garment among the supplies and other items in the backpack.

Previous attempts to improve backpacks by combining them with articles of clothing include a coat and detachable knapsack, as shown in U.S. Pat. No. 2,248,455. A disadvantage of that device was that it included straps inside the coat such that the backpack could not be functional independently of the coat and, thus, severly restricted its use and versatility.

Other arrangements were shown in U.S. Pat. Nos. 1,959,331 and 4,057,854. The devices of those patents, however, were directed to garments that were convertible into backpacks rather than a combined backpack and article of clothing. A further form of combination pack bag is disclosed in U.S. Pat. No. 2,428,795 and describes a sleeping bag and pack.

The combination cargo pack of this invention includes a garment pouch for permanently retaining a protective garment.

DISCLOSURE OF THE INVENTION

The nature of this invention involves a cargo pack having a cooperatively connected garment such as a jacket with a head covering.

The invention is intended to synergistically provide a cargo pack with a load carrying capacity for usage as a backpack and the ready availability of a jacket when needed, without limitation as to the load carrying applications of the backpack.

In summary, the device of this invention is directed to a cargo pack in the form of a flexible wall or soft side pack having a plurality of pockets, and including shoulder straps for supporting the pack.

A jacket is affixed to the pack by stitching a back portion of the jacket to an interior partition wall of the pack. The jacket can be folded and concealed within a separate pouch included in the pack. When it is desired to wear the jacket, a flap closure can be opened without disturbing articles that may be stored in the other compartments of the backpack. Furthermore, the union of the backpack and the jacket is positioned such that the backpack can be supported by the shoulder straps while the jacket is being worn.

A feature of this invention, therefore, is that the jacket is permanently secured to and stored within the backpack for removal without disturbing the other articles within the pack.

A further advantage is that the backpack has independent utility when the jacket is not being worn.

Having thus summarized the invention, it will be seen that it is an object thereof to provide a combination cargo pack of the general character described herein which is not subject to the aforementioned disadvantages.

Another object of this invention is to provide a cargo pack which synergistically combines a backpack and clothing article.

A further object of this invention is to provide a combination cargo pack having a jacket adapted for self storage within the pack.

Yet another object of this invention is to provide a combination cargo pack wherein the jacket is conveniently joined to the pack.

Still another object of this invention is to provide a combination cargo pack wherein the jacket provides a cushion for comfortably supporting the load.

Still another object of this invention is to provide a combination cargo pack which is simple in construction, reliable in use, and well adapted for mass production fabrication techniques.

Other objects of this invention in part will be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown an exemplary embodiment of the invention.

BEST MODE FOR CARRYING OUT THE INVENTION

Figure 1:
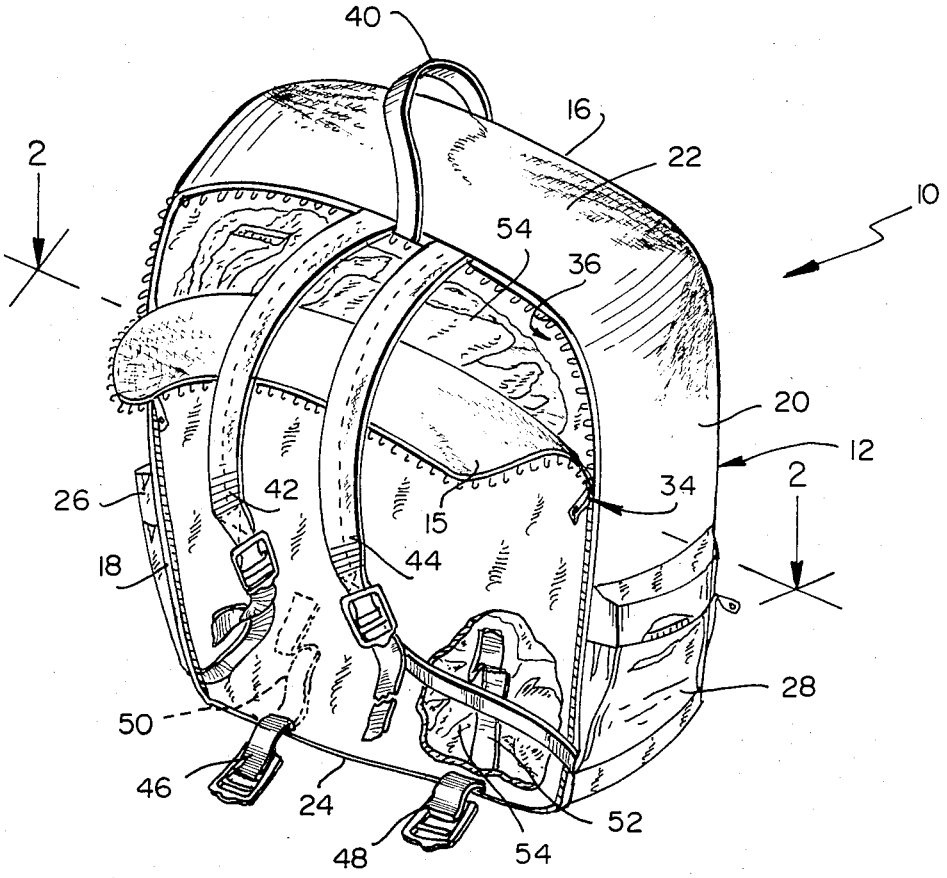
FIG. 1 is a perspective view showing a combination cargo pack in accordance with this invention.

Referring now in detail to the invention, the reference numeral 10 denotes generally a combination cargo pack in accordance with this invention.

Figure 2:
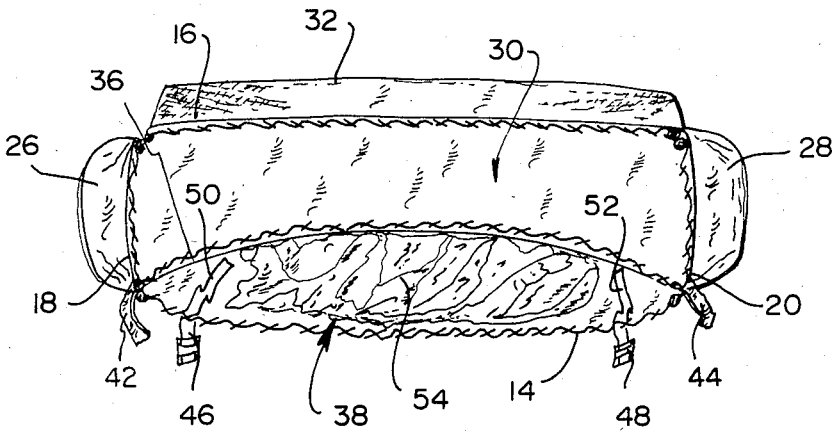
FIG. 2 is a sectional view taken substantially along line 2—2 of FIG. 1 showing an arrangement of storage pockets and a garment pouch formed between an interior partition and a front panel.

A combination pack 10, for the purpose of this exemplary embodiment, is shown as being a substantially rectangular carry case or pack 12. The pack 12, as illustrated in FIGS. 1 and 2, includes a front panel 14, a back panel 16, a pair of side panels 18, 20, a top panel 22, and a bottom panel 24, each of which is connected along its mutually coincident edges and is preferably constructed of a lightweight, flexible, water repellant and durable material such as nylon or canvas fabric. A plurality of storage compartments are typically illustrated as a pair of side pockets 26, 28, a back panel full-depth pocket 30, and an intermediate-depth back panel outer pocket 32. Each of the pockets 26, 28, 30, and 32 is provided with a respective slide fastener as are conventionally available. In addition, the front panel 14 is releasably secured along three of its sides by a slide fastener 34 to form a closure flap 15. An interior partition 36 separates the back panel full-depth pocket 30 from a front garment pouch 38 formed between the interior partition 36 and the front panel 14.

Other aspects of the pack 12 include a strap handle 40 sewn to the panel 22 for hand carrying, and a pair of adjustable length shoulder straps 42, 44 for shoulder supported carrying of the pack 12. In addition, a set of friction buckles 46, 48 attached to the bottom panel 24, are adapted for receiving a set of tie-down straps 50, 52 which are secured respectively at one end within the garment pouch 38 and will be further described hereinafter.

Figure 5:
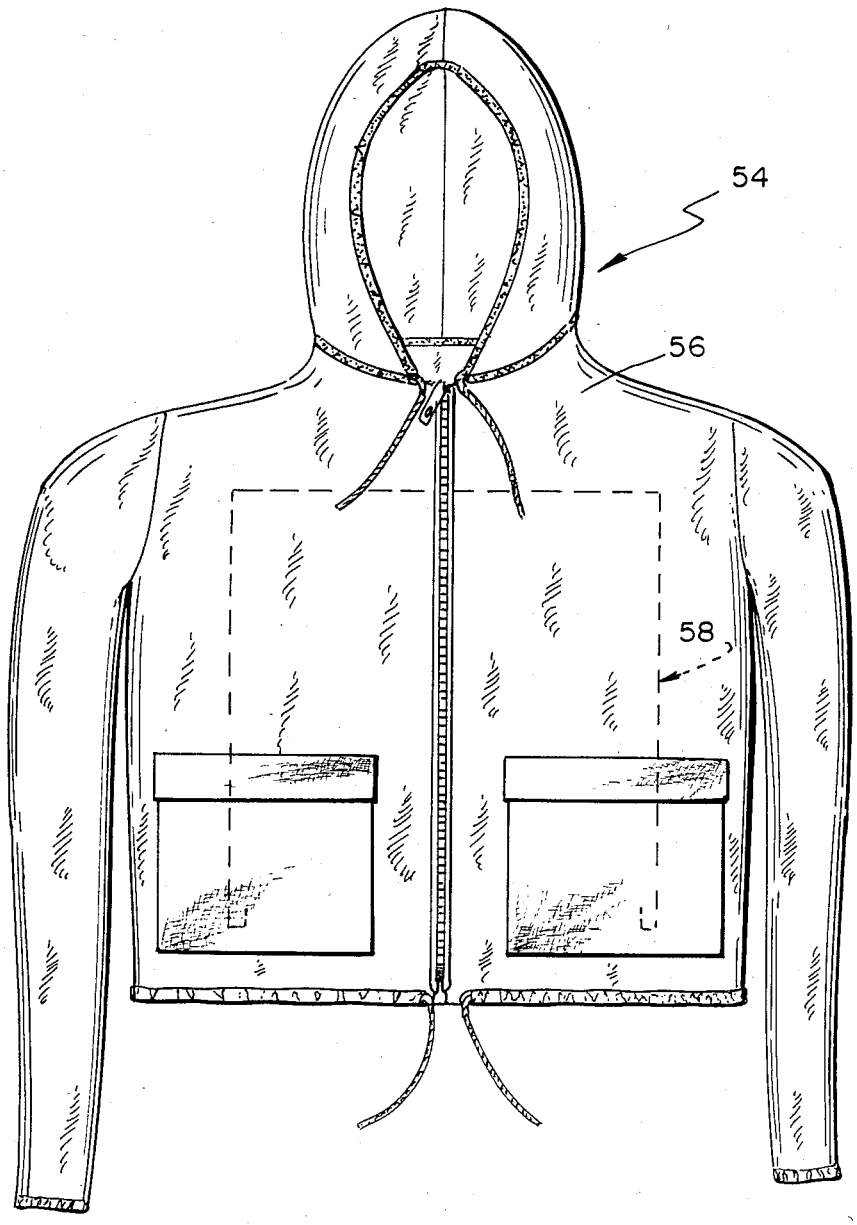
FIG. 5 is a view of the inside of the jacket showing a back portion as sewn to the interior partition.

The garment pouch 38 is provided with a permanently secured protective garment such as a hooded jacket 54. It should be noted, however, that a parka, coat, or other clothing item could be readily substituted for the jacket 54. The jacket 54 is preferably made of a lightweight water repellent material such as nylon fabric having a shell constructed which can include the hood. A back portion 56 of the jacket 54 is positioned in confronting relationship with the interior partition 36 and registered so that the pack 12 will lie at the shoulder and back supporting region of the wearer. In this exemplary embodiment, the line of stitching 58 joins the back portion 56 to the interior partition 36, as shown in FIG. 5. When the jacket 54 is not in use it is foldably stored within the pouch 38 and the pack 12 can be used separately from the jacket 54.

Figure 3:
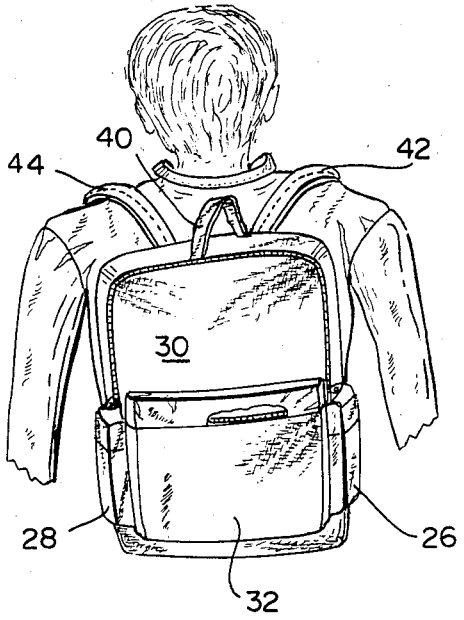
FIG. 3 is a perspective view showing the cargo pack in a shoulder supported position with the jacket stored within the garment pouch.

The illustration of FIG. 3 shows the pack 12 with the flap closure 15 registering against the wearer's shoulder and back supporting region and the shoulder straps 42, 44 encircling the wearer's shoulders and arms for carrying the load. It should also be noted that the jacket 54, enclosed within the pouch 38, will "cushion" the weight of load or otherwise soften the load impact. Additional materials, such as a foam-rubber padding, can be optionally incorporated for further impact absorption.

Figure 4:
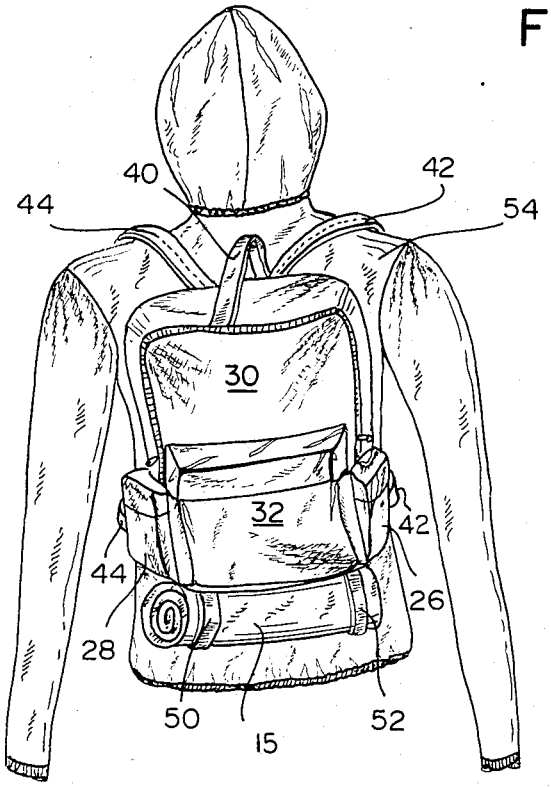
FIG. 4 is a perspective view showing the cargo pack in a shoulder supported position with the jacket removed and being worn.

When it is desired to wear the jacket 54, the pack 12 is removed and the flap closure 15 is opened by use of the slide fastener 34. It should be obvious that the jacket 54 is accessible without disturbing the contents of any of the remaining storage pockets 26, 28, 30, or 32. The flap closure 15 can be conveniently retained in this "open" position by rolling or folding the fabric toward the bottom panel 24 and by fastening the closure 15 by use of the tie-down straps 50, 52 and the companion buckles 46, 48, as shown in FIG. 4.

In view of the following, it should be seen that there is provided a combination cargo pack which achieves the various objects of this invention and which is well adapted to meet the conditions of practical use.

Since various possible embodiments might be made of the present invention or modifications might be made to the exemplary embodiment set forth, it is to be understood that all of the materials shown and described in the accompanying drawings are to be interpreted as illustrative and not in a limiting sense.

Having thus described the invention, there is claimed as new and desired to be secured by Letters Patent:

1. A combination cargo pack comprising a carry pack defining at least one storage compartment, support means secured to the pack including a shoulder strap for carrying the pack, a garment attached to the pack and adapted for storage within the pack, flap closure means on the pack for providing selective access to the garment, said garment being affixed to the pack so as to register the pack in a shoulder strap carrying mode when the garment is worn.

2. A combination cargo pack as claimed in claim 1 wherein the pack is provided with an interior partition, said interior partition and flap closure defining a garment pouch therebetween for storage of the garment.

3. A combination cargo pack as claimed in claim 2 wherein the flap closure is formed from a front panel of the pack and further includes fastener securement.

4. A combination cargo pack as claimed in claim 2 wherein retention means are provided for securing a flap closure in an open position when the garment is worn.

5. A combination cargo pack as claimed in claim 4 wherein retention means includes a tie-down strap affixed within the garment pouch and cooperative fastening means affixed to an outer portion of the pack and adapted for registered interconnection with the tie-down strap to secure the flap closure therebetween.

6. A combination cargo pack as claimed in claim 2 wherein the garment is joined to the interior partition of the pack.

7. A combination cargo pack as claimed in claim 6 wherein a back portion of the garment is attached in confronting relationship with the interior partition and adapted for registration against the wearer's shoulder and back.

8. A combination cargo pack as claimed in claim 7 wherein the flap closure is adapted for registration against the wearer's shoulder and back.

9. A combination cargo pack as claimed in claim 8 wherein the garment as stored within the pouch provides cushion means for softening the weight of the load.

10. A combination cargo pack as claimed in claim 5 wherein the garment is a jacket.

* * * * *